US006264276B1

(12) United States Patent
Chen

(10) Patent No.: US 6,264,276 B1
(45) Date of Patent: Jul. 24, 2001

(54) ADJUSTABLE CONNECTING DEVICE FOR INTERCONNECTING SEAT AND BACKREST MEMBERS OF A CHAIR

(76) Inventor: Su-Ming Chen, No. 566, Fong-Lin 2nd Rd., Ta-Liao Hsiang, Kaohsiung Hsien (TW)

( * ) Notice: Subject to any disclaimer, the term of this patent is extended or adjusted under 35 U.S.C. 154(b) by 0 days.

(21) Appl. No.: 09/620,794

(22) Filed: Jul. 21, 2000

(51) Int. Cl.[7] ..... B60N 2/02
(52) U.S. Cl. ..... 297/353
(58) Field of Search ..... 297/353, 383, 297/410, 411.36, 463.1; 248/407, 408, 409, 423

(56) References Cited

U.S. PATENT DOCUMENTS 4,012,158 * 3/1977 Harper .
4,036,525 * 7/1977 Howk .
4,639,039 * 1/1987 Donovan .
4,749,230 * 6/1988 Tornero .
5,649,741 * 7/1997 Beggs .
5,685,609 * 11/1997 Miotto .
5,695,249 * 12/1997 Loffi .
5,951,107 * 9/1999 Tornero .
6,209,840 * 4/2001 Chen .

* cited by examiner

*Primary Examiner*—Milton Nelson, Jr.
(74) *Attorney, Agent, or Firm*—Merchant & Gould P.C.

(57) ABSTRACT

An adjustable connecting device includes an elongated sliding member secured to a backrest member, and a mounting frame having one end secured to a seat member of a chair and an opposite end connected to a mounting portion disposed rearwardly of a multilevel engaged member that is mounted to the sliding member such that the sliding member is slidable linearly relative to the mounting portion. A pawl portion is disposed in the mounting portion and is provided with an engaging key capable of sliding along a keyway in the multilevel engaged member and engaging one of a plurality of notches communicated with the keyway. An arrest member is disposed to move with the multilevel engaged member so as to grip or release the engaging key.

6 Claims, 10 Drawing Sheets

ADJUSTABLE CONNECTING DEVICE FOR INTERCONNECTING SEAT AND BACKREST MEMBERS OF A CHAIR

BACKGROUND OF THE INVENTION

1. Field of the Invention

The invention relates to an adjustable connecting device for interconnecting seat and backrest members of a chair, more particularly to a concealable height adjustable device adapted to adjust the height of the backrest member relative to the seat member.

2. Description of the Related Art

FIG. 1 shows a conventional backrest-height adjustable chair 1. The chair 1 includes a seat member 11, a backrest member 12, an upright post 13 disposed at a bottom side of the seat member 11, and a connecting device 2 for interconnecting the seat and backrest members 11, 12. The backrest member 12 includes front and rear backrest portions 121, 122. With reference to FIG. 2, the connecting device 2 includes a casing 21 and a generally L-shaped mounting frame 22 having an upper end portion inserted into the casing 21. The casing 21 and the mounting frame 22 are capable of sliding displacement relative to each other. The casing 21 is provided with a retaining key 211 that can be manipulated to slide along a keyway 221 in the upper end portion of the mounting frame 22 to engage one of a plurality of notches 222 communicated with the keyway 221 so as to position the backrest member 12 at a desired level. During assembly, the casing 21 together with the upper end portion of the mounting frame 22 retained therein has to be first secured to the rear side of the front backrest portion 121 or the front side of the rear backrest portion 122 at four corner portions 223 thereof via screws 224 before the front and rear backrest portions 121, 122 can be coupled. Then, a lower end portion of the mounting frame 22 is secured to the seat member 11.

Since the casing 21 together with the upper end portion of the mounting frame 22 have to be secured firmly to the front or rear backrest portion 121, 122 before the front and rear backrest portions 121, 122 are coupled, the connecting device 2 is usually connected to the backrest member 2 in the factory before delivery to retailers, where the backrest member 12 is connected to the seat member 11. As the L-shaped mounting frame 22 projects from the backrest member 12 to quite a distance, a large amount of packaging material is needed. Besides, if the height of the backrest member 12 relative to the seat member 11 has to be further adjusted, the front and rear backrest portions 121, 122 have to be taken apart.

SUMMARY OF THE INVENTION

Therefore, the object of the present invention is to provide an adjustable connecting device for interconnecting seat and backrest members of a chair, which can overcome the above-mentioned problems.

Accordingly, the adjustable connecting device of the present invention is adapted to be mounted between a seat member and a backrest member of a chair. The back rest member extends in an upright direction. The connecting device includes a mounting frame, an elongated sliding member, and a slidable and unidirectionally retaining mechanism. The mounting frame includes a proximate end portion adapted to be secured to the seat member, and a distal end portion extending from the proximate end portion in the upright direction and adapted to be disposed rearwardly of the backrest member. The elongated sliding member is adapted to be secured to the backrest member. The retaining mechanism is disposed between the distal end portion and the elongated sliding member to position the distal end portion relative to the elongated sliding member, and includes a linear-movement actuated engaging member, a multilevel engaged member, an arrest member, and a barrier member. The linear-movement actuated engaging member includes: a mounting portion with first and second mounting walls opposite to each other in a first transverse direction relative to the upright direction; a pawl portion having a pivot end pivotally mounted to the first mounting wall about a pivot axis parallel to the first transverse direction, and an engaging end provided with an engaging key which extends in the first transverse direction; and a first biasing member disposed to bias the engaging key to turn clockwise about the pivot axis, and to displace in a second transverse direction which is transverse to both the upright direction and the first transverse direction. The multilevel engaged member includes first and second retaining walls opposite to each other in the first transverse direction and slidable relative to the first mounting wall of the mounting portion in the upright direction. The first retaining wall has first and second inner lateral edges spaced apart from each other in the second transverse direction to define a keyway extending in the upright direction between upper and lower limits to receive and permit the engaging key to move relative to the keyway between the upper and lower limits. The first inner lateral edge defines a plurality of notches spaced apart from one another in the upright direction, and between the upper and lower limits. The notches extend in the second transverse direction and are communicated with the keyway so as to form a plurality of ratchet teeth such that once the multilevel engaged member has been moved downward to a first position, where the upper limit is brought to abut against the engaging key, an initial upward movement of the multilevel engaged member from the first position will permit the engaging key to be biased by the first biasing member to move into and be engaged within one of the notches. A subsequent upward movement of the multilevel engaged member will cause the engaging key to slide over a corresponding one of the ratchet teeth against the biasing action of the first biasing member and to move into and be engaged within a next one of the notches until a second position is reached, where the engaging key abuts against the lower limit. The arrest member is disposed to be moved with the multilevel engaged member from the first or second position so as to release the engaging key or to grip the engaging key such that the engaging key is confined within the keyway when the multilevel engaged member is being moved downward from the second position to the first position. The barrier member is disposed to hinder the arrest member from being moved with the upward movement of the multilevel engaged member so as to set the arrest member ready for moving with the downward movement of the multilevel engaged member to grip the engaging key.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
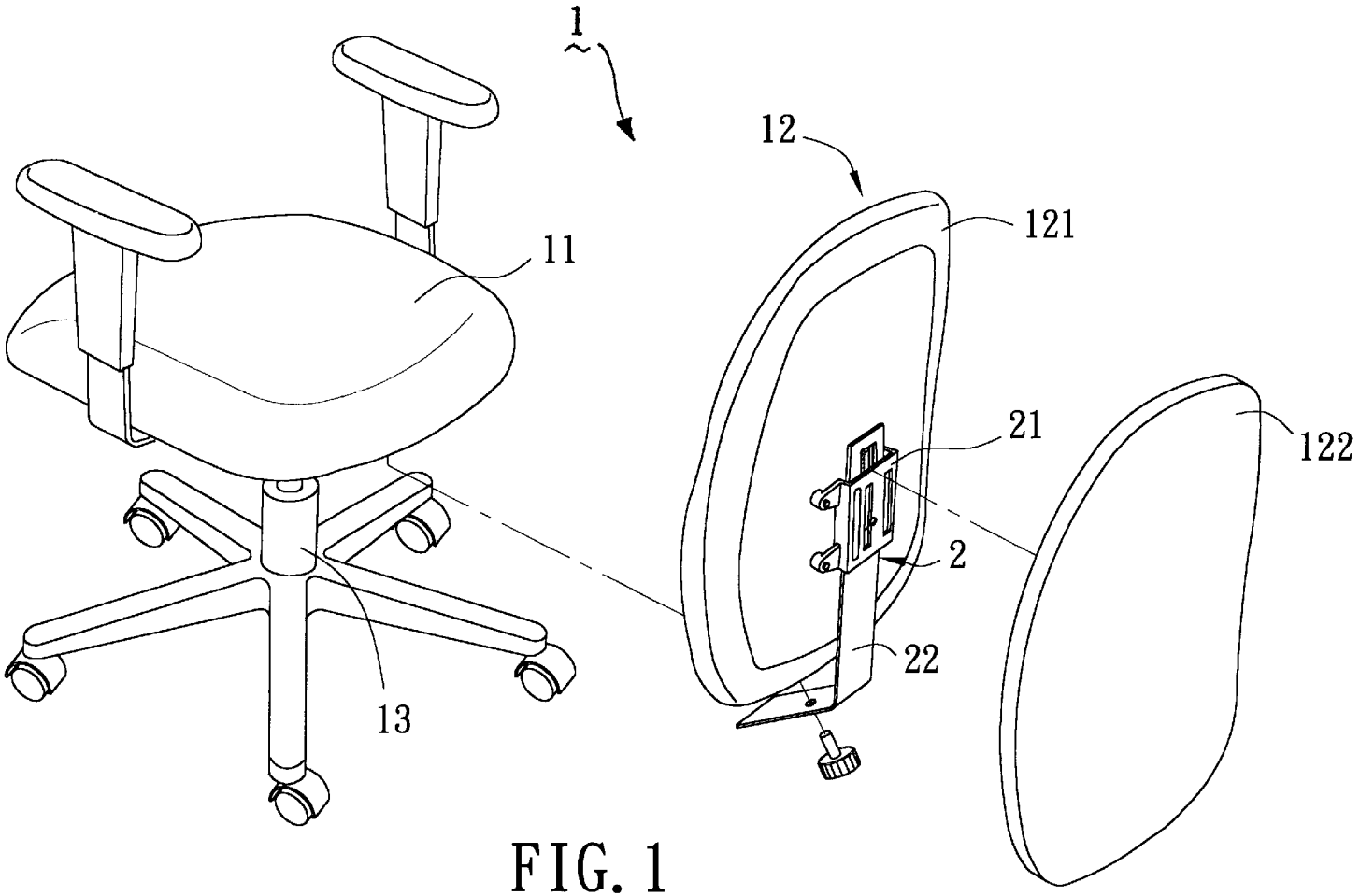
FIG. 1 PRIOR ART
FIG. 1 is an exploded perspective view of a conventional backrest-height adjustable chair.
Figure 2:
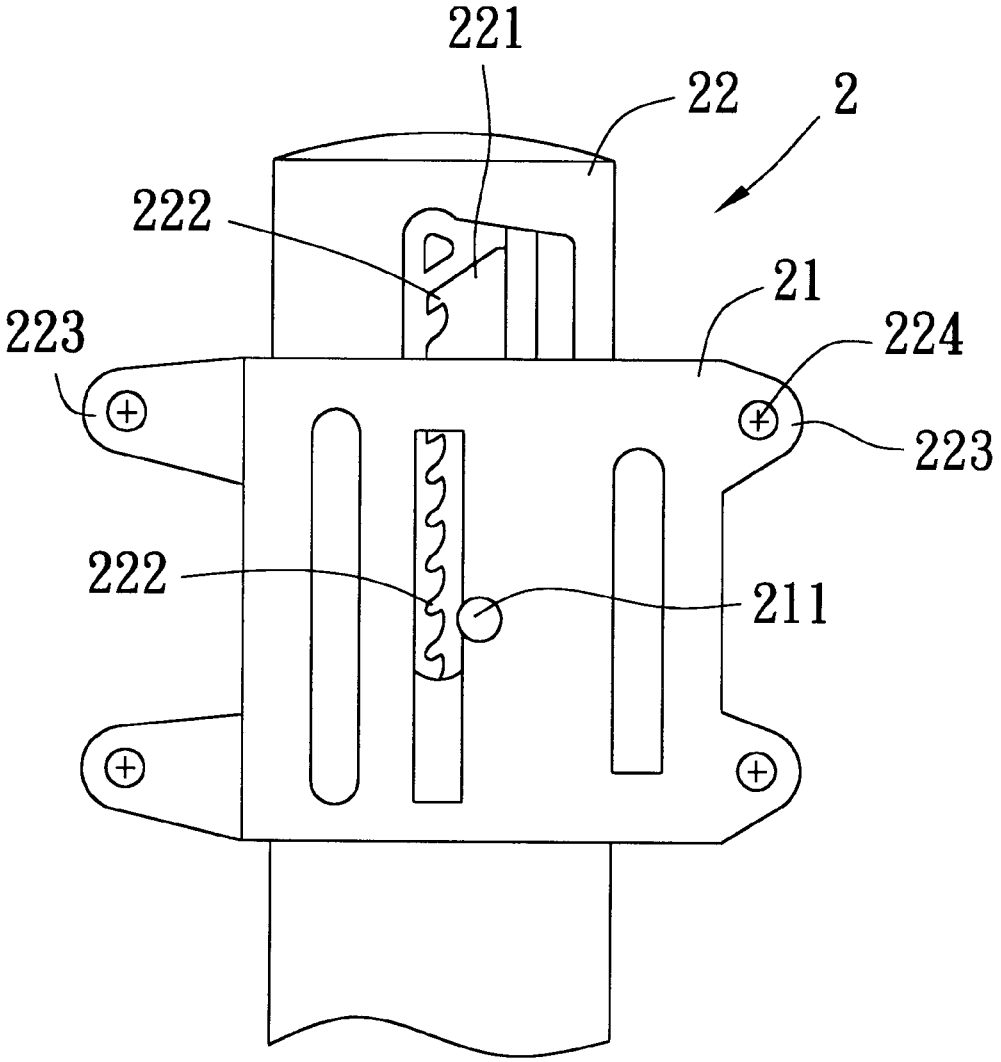
FIG. 2 PRIOR ART
FIG. 2 is a front view of a connecting device of the conventional backrest-height adjustable chair.
Figure 3:
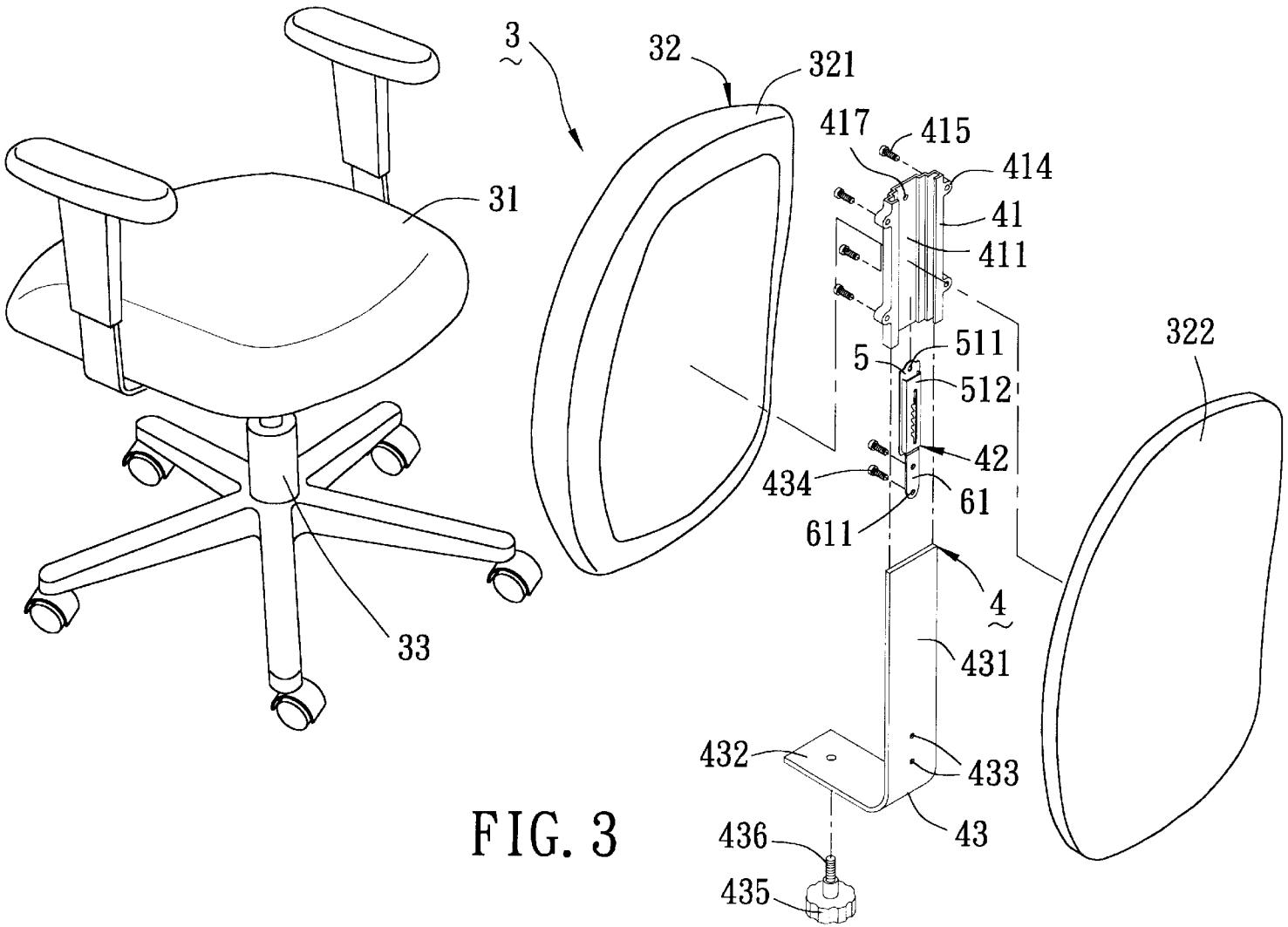
FIG. 3 is an exploded perspective view of a preferred embodiment of an adjustable connecting device for interconnecting seat and backrest members of a chair of the present invention.
Figure 4:
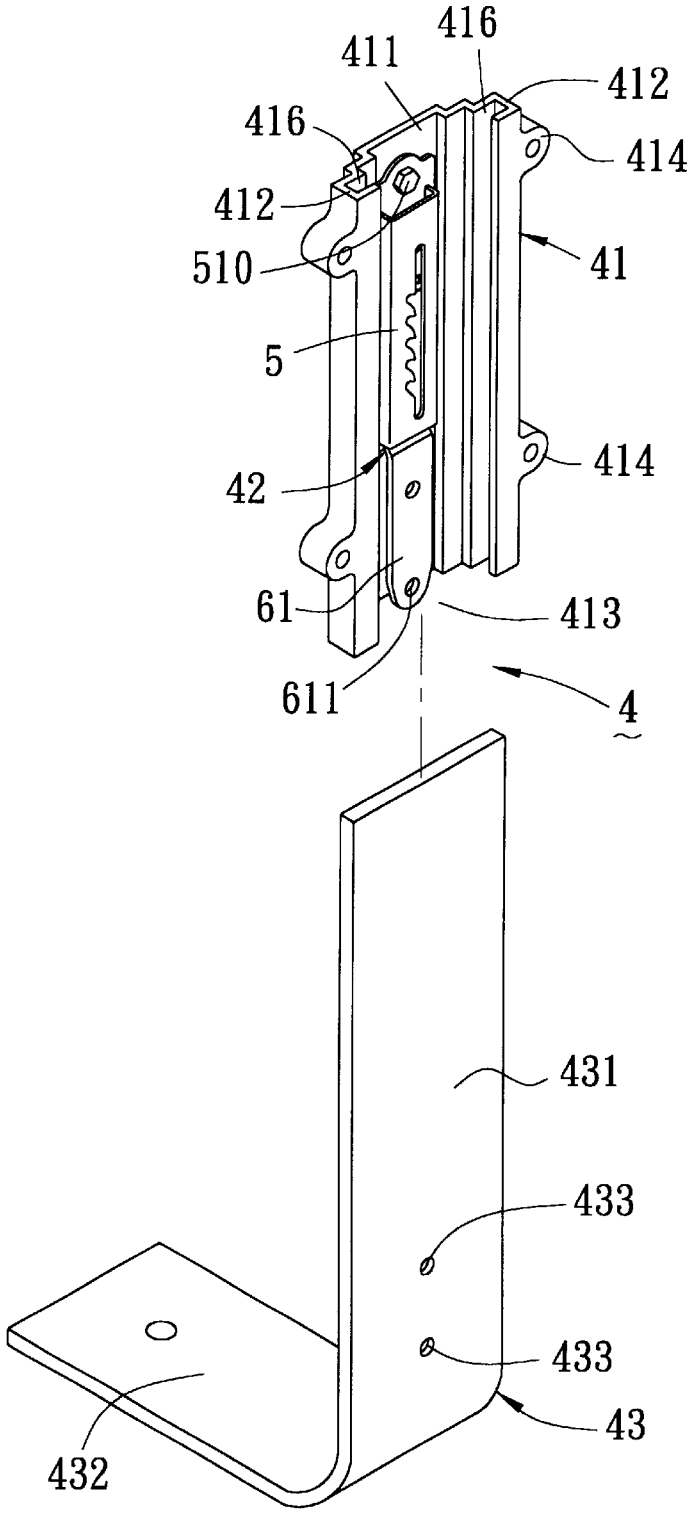
FIG. 4 is a partly exploded perspective view of the preferred embodiment.

Referring to FIGS. 3, 4, 6, 7 and 8, the preferred embodiment of an adjustable connecting device 4 according to the present invention is shown to be adapted to be mounted between a seat member 31 and a backrest member 32 of a chair 3. The seat member 31 is supported on an upright post 33. The backrest member 32 includes inter-engageable front and rear backrest portions 321, 322. The adjustable connecting device 4 extends in an upright direction and, as shown, includes a mounting frame 43, an elongated sliding member 41, and a slidable and unidirectionally retaining mechanism 42.

The mounting frame 43 is a generally L-shaped plate having a horizontal proximate end portion 432 adapted to be removably secured to an underside of the seat member 31 through the use of a rotary knob 435 with a threaded rod 436, and a vertical distal end portion 431 extending from the proximate end portion 432 in the upright direction and adapted to be disposed rearwardly of the backrest member 32 or between the front and rear backrest portions 321, 322 of the backrest member 32. The distal end portion 431 is provided with a couple of positioning holes 433.

The elongated sliding member 41 is adapted to be secured fixedly to a rear side of the front backrest portion 321 or to a front side of the rear backrest portion 322, and has a sliding plate portion 411 extending in the upright direction.

Figure 8:
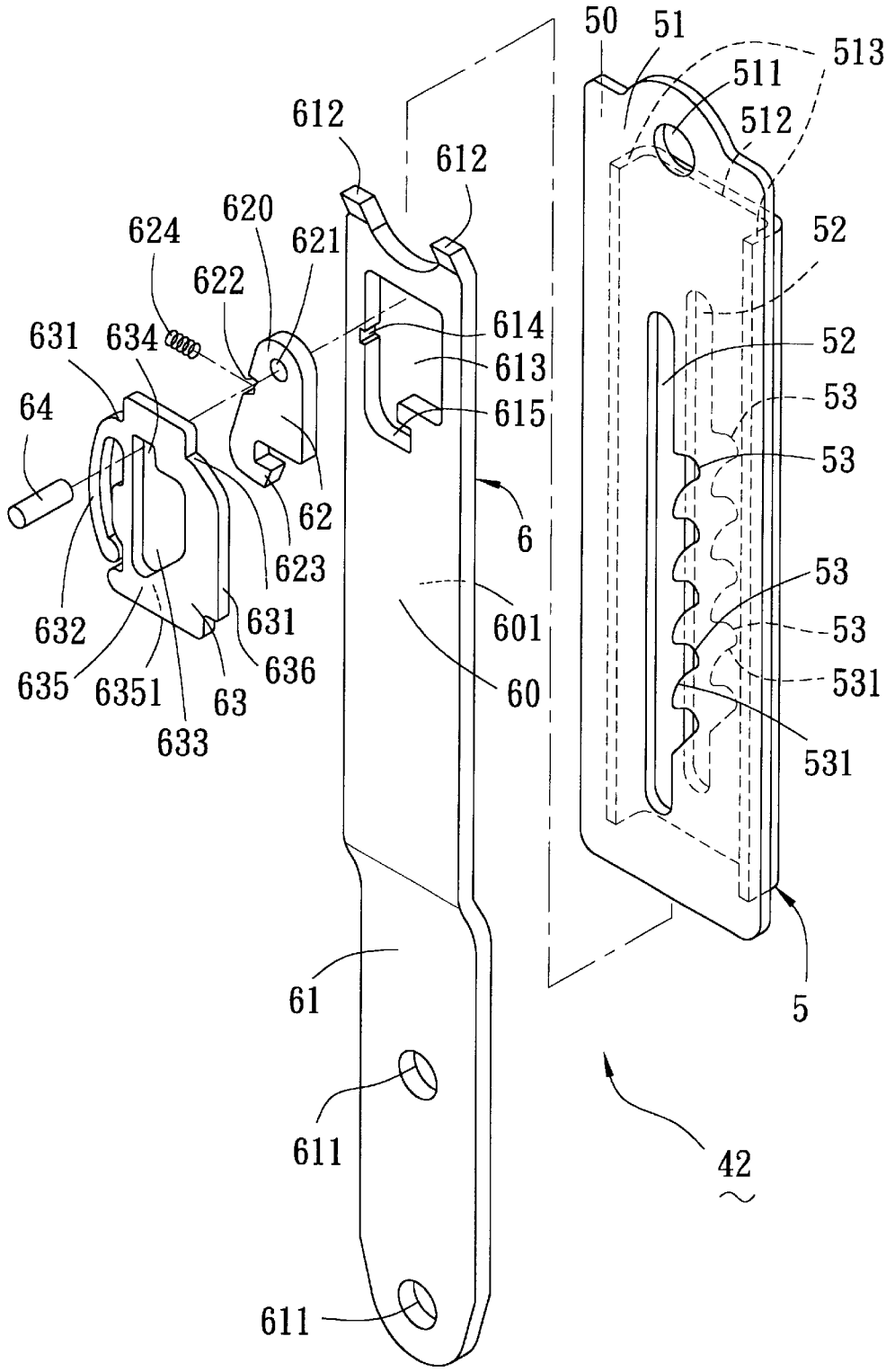
FIG. 8 is an exploded perspective view of the retaining mechanism of the preferred embodiment.

The retaining mechanism 42 is disposed between the distal end portion 431 and the elongated sliding member 41 to position the distal end portion 431 relative to the elongated sliding member 41. Referring to FIG. 8, the retaining mechanism 42 includes a linear-movement actuated engaging member, a multilevel engaged member 5, an arrest member 63, and a barrier member 612. The linear-movement actuated engaging member includes a mounting portion 6, a pawl portion 62, and a first biasing member 624. The mounting portion 6 has first and second mounting walls 60, 601 opposite to each other in a first transverse direction relative to the upright direction. The first mounting wall 60 defines a receiving hole 613 extending to communicate the first mounting wall 60 with the second mounting wall 601 and confined by a lateral sidewall and a lower wall. The lateral sidewall is formed with a first abutment notch 614. The lower wall is formed with an insert groove 615. In this embodiment, the mounting portion 6 is an elongated plate with a lower mounting plate portion 61 having a couple of positioning holes 611 such that the mounting portion 6 can be removably mounted to the distal end portion 431 of the mounting frame 43 through the use of screws 434. Alternatively, the mounting portion 6 may be configured to be an integral part of the distal end portion 431 of the mounting frame 43. The pawl portion 62 has a size slightly smaller than that of the receiving hole 613, and is disposed in the receiving hole 613 with a pivot end 623 thereof pivotally mounted in the insert groove 615 about a pivot axis parallel to the first transverse direction. The pawl portion 62 further has an engaging end 620 formed with a key hole 621 for extension of an engaging key 64 therethrough in the first transverse direction, and a second abutment notch 622 in a lateral sidewall thereof, adjacent to the key hole 621.

The first biasing member 624 is a coil spring in this embodiment, and has a rear end abutting against the first abutment notch 614, and a front end abutting against the second abutment notch 622. The first biasing member 624 is disposed to bias the engaging key 64 to turn clockwise about the pivot axis, and to displace in a second transverse direction which is transverse to both the upright direction and the first transverse direction.

The pawl portion 62 is disposed in the receiving hole 613 in the mounting portion 6 such that the pivot end 620 and the engaging end 623 do not extend beyond the first and second mounting walls 60, 601 in the first transverse direction, and such that the engaging key 64 extends to be beyond the first mounting wall 60.

Figure 9:
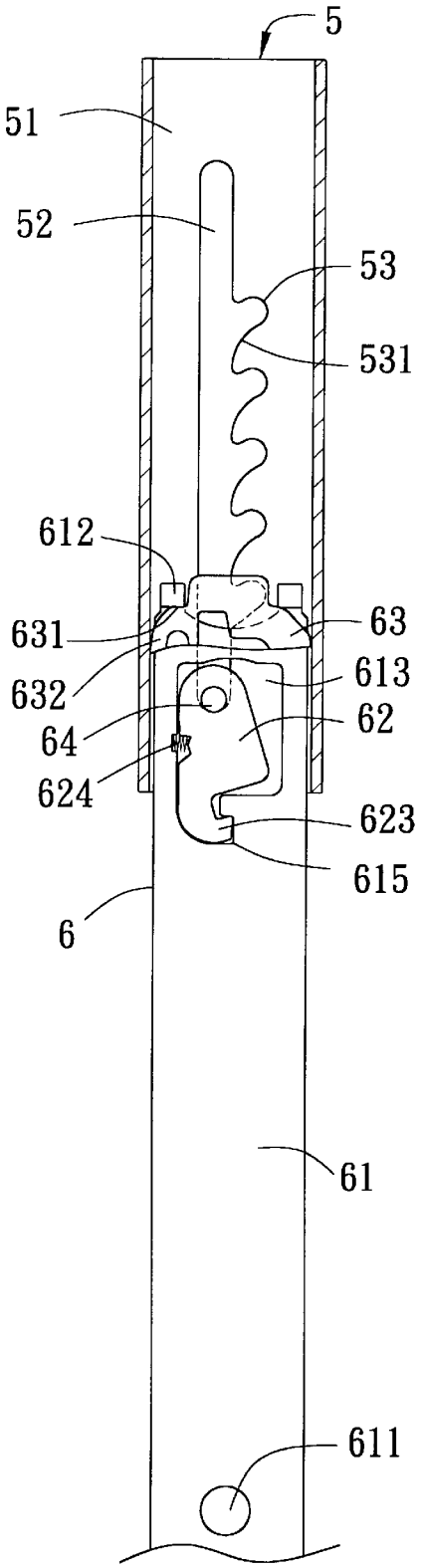
FIG. 9 is a front sectional view, illustrating an engaging key of the preferred embodiment at a lower limit.
Figure 11:
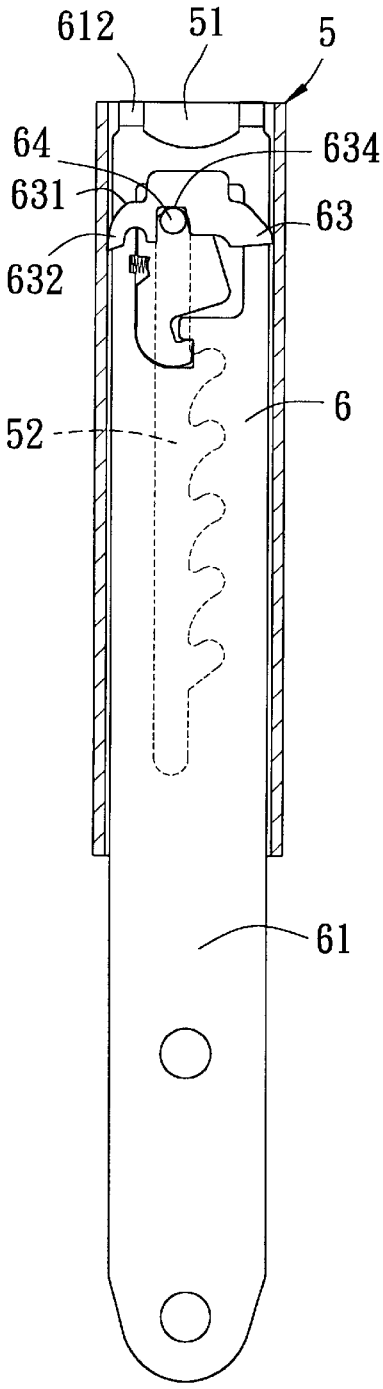
FIG. 11 is a front sectional view illustrating the engaging key of the preferred embodiment at an upper limit.
Figure 12:
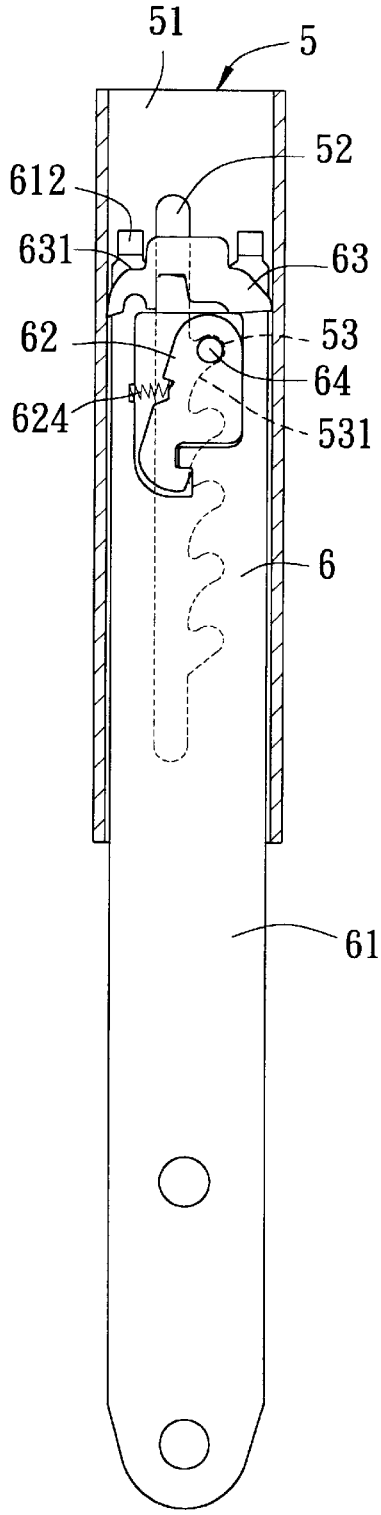
FIG. 12 is a front sectional view illustrating the engaging key of the preferred embodiment retained in a notch of a multilevel engaged member.

The multilevel engaged member 5 is secured to the elongated sliding member 41 by means of a locking element 510 passing through a through hole 511 in an upper end thereof and a through hole 417 in an upper end of the sliding plate portion 411. The multilevel engaged member 5 includes first and second retaining walls 51, 50 opposite to each other in the first transverse direction and slidable relative to the first mounting wall 60 of the mounting portion 6 in the upright direction. The first retaining wall 51 has first and second inner lateral edges spaced apart from each other in the second transverse direction to define a keyway 52 that extends in the upright direction between upper and lower limits to receive and permit the engaging key 64 to move relative to the keyway 52 between the upper and lower limits. The first inner lateral edge defines a plurality of notches 53 spaced apart from one another in the upright direction, and between the upper and lower limits. The notches 53 extend in the second transverse direction, and are communicated with the keyway 52 so as to form a plurality of ratchet teeth 531 that have downwardly inclining edges. As such, once the multilevel engaged member 5 has been moved downward to a first position where the upper limit is brought to abut against the engaging key 64, as shown in FIG. 11, an initial upward movement of the multilevel engaged member 5 from the first position will permit the engaging key 64 to be biased by the first biasing member 624 to move into and be engaged within one of the notches 53, as shown in FIG. 12. A subsequent upward movement of the multilevel engaged member 5 will cause the engaging key 64 to slide over a corresponding one of the ratchet teeth 531 against the biasing action of the first biasing member 624 and to move into and be engaged within a next one of the notches 53 until a second position is reached, where the engaging key 64 abuts against the lower limit, as shown in FIG. 9. By means of such an arrangement, the relative distance between the seat member 31 and the backrest member 32 may be adjusted by varying the extension of the lower mounting plate portion 61 from a lower end of the backrest member 32.

Figure 10:
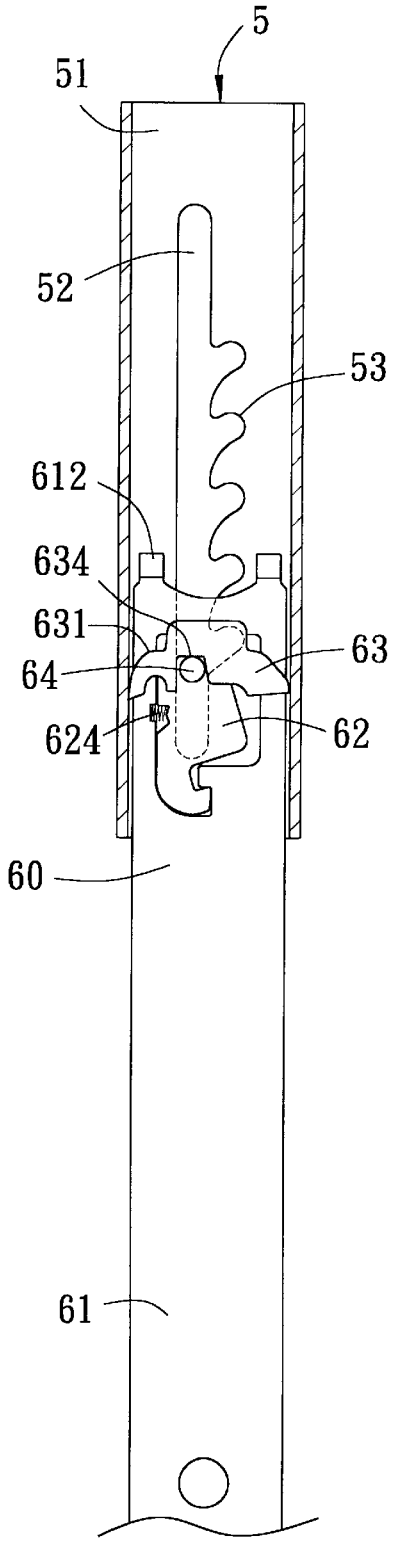
FIG. 10 is a front sectional view illustrating the engaging key of the preferred embodiment in a gripped state.

The arrest member 63 is disposed to be moved with the multilevel engaged member 5 from the first or second position so as to release the engaging key 64 (see FIGS. 9 and 12) or to grip the engaging key 64 such that the engaging key 64 is confined within the keyway 52 when the multilevel engaged member 5 is being moved downward from the second position to the first position (see FIGS. 10 and 11). The arrest member 63 includes first and second gripping walls 635, 6351 opposite to each other in the first transverse direction, and disposed to face the second retaining wall 50 and the first mounting wall 60, respectively. The first gripping wall 635 includes a gripping slot 634 extending in the upright direction, and in the first transverse direction to communicate the first gripping wall 635 with the second gripping wall 6351 so as to accommodate and permit the engaging key 64 to be gripped. The gripping slot 634 is communicated with an enlarged slot portion 633 that permits movement of the engaging key 64 therein when it is released by the arrest member 63 so that the pawl portion 62 and hence the engaging key 64 may be biased by the first biasing member 634 in the second transverse direction. The arrest member 63 further has right and left lateral walls 636 opposite to each other in the second transverse direction, and disposed to be urged by biasing action of a second biasing member 632, a resilient arm in this embodiment, to move away from each other, and a pair of shoulder portions 631 extending respectively from the right and left lateral walls 636 upwardly and inwardly.

The barrier member 612 is disposed to hinder the arrest member 63 from being moved with the upward movement of the multilevel engaged member 5 so as to set the arrest member 63 ready for moving with the downward movement of the multilevel engaged member 5 to grip the engaging key 64. In this embodiment, the barrier member 612 includes a pair of block members 612 that are disposed above the gripping slot 634, and that are formed by bending an uppermost end of the mounting portion 6 (or the distal end portion 431 in case the mounting portion 6 is formed integrally with the mounting frame 43) towards the second retaining wall 50 so as to respectively abut against the shoulder portions 631 when the engaging key 64 is in the second position.

In addition, a substantially U-shaped plate 512 may be secured to the second retaining wall 50 to define a mounting space for receiving the mounting portion 6. The U-shaped plate 512 has a plate portion and right and left abutment walls 513. The plate portion is configured to be a mirror image of the second retaining wall 50 in that it defines a keyway 52, and has notches 53 and ratchet teeth 531. The right and left abutment walls 513 are disposed on the second retaining wall 50 to extend in the upright direction, and are spaced apart from each other in the second transverse direction by such a distance as to frictionally contact the right and left lateral walls 636 of the arrest member 63 to thereby permit the arrest member 63 to move with the downward movement of the multilevel engaged member 5.

Additionally, the distal end portion 431 has right and left sidewalls opposite to each other in the second transverse direction. The elongated sliding member 41 has right and left edges 412 opposite to each other in the second transverse direction to define an insert space 413 in the upright direction and between the front and rear backrest portions 321, 322 such that the multilevel engaged member 5 is confined between the sliding plate portion 411 and the insert space 413. Right and left guiding grooves 416 are disposed respectively on the right and left edges 412 and extend in the upright direction such that they may slidably ride on the right and left sidewalls of the distal end portion 431, thereby stabilizing the upward and downward movements of the multilevel engaged member 5. Furthermore, a pair of mounting lugs 414 extend outwardly from each of the right and left edges 412 at upper and lower ends thereof for passage of screws 415 that lock the elongated sliding member 41 to the backrest member 32.

Figure 5:
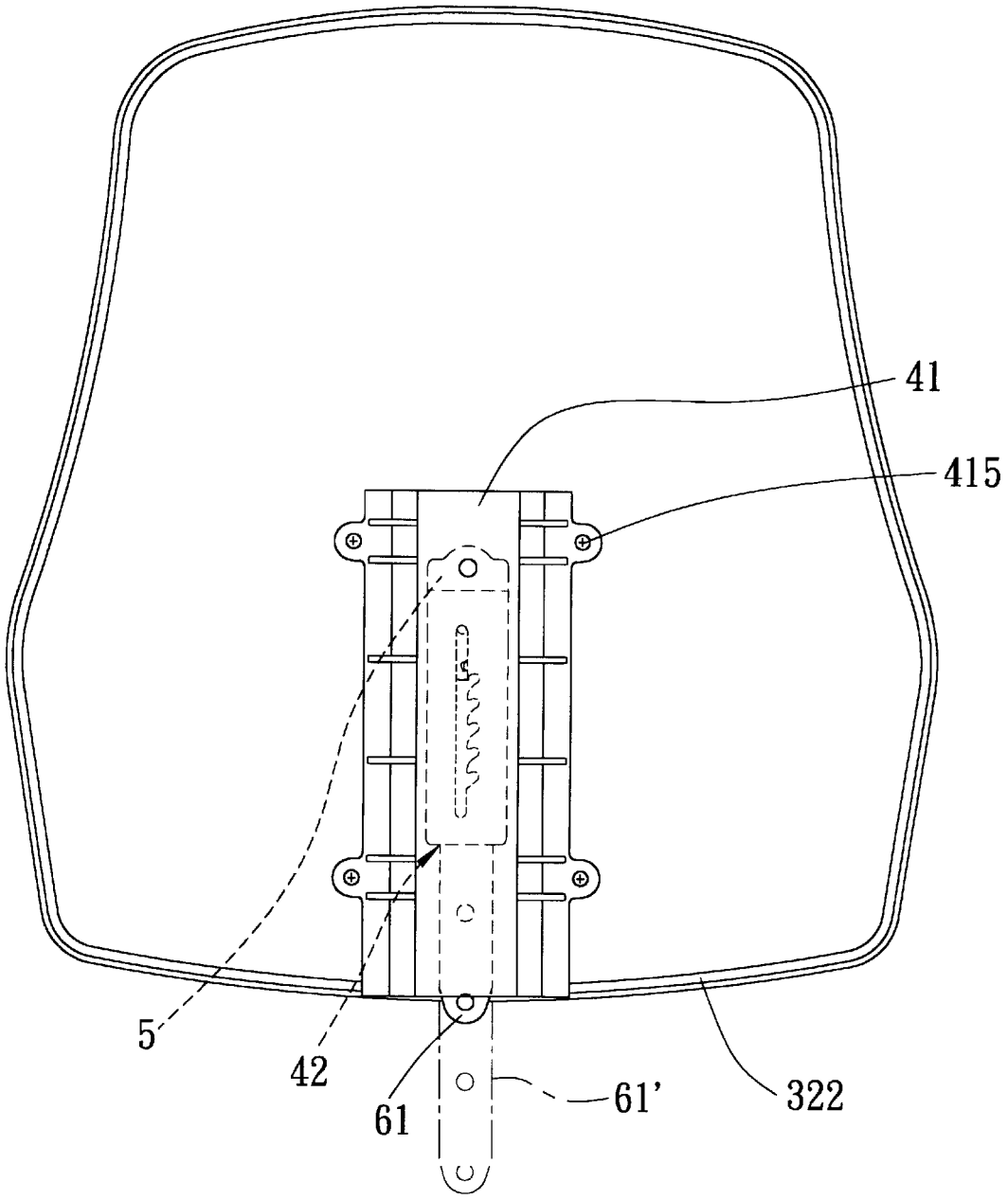
FIG. 5 is a schematic front view illustrating assembly of an elongated sliding member and a retaining mechanism of the preferred embodiment, viewed from a front side of a rear backrest portion.
Figure 6:
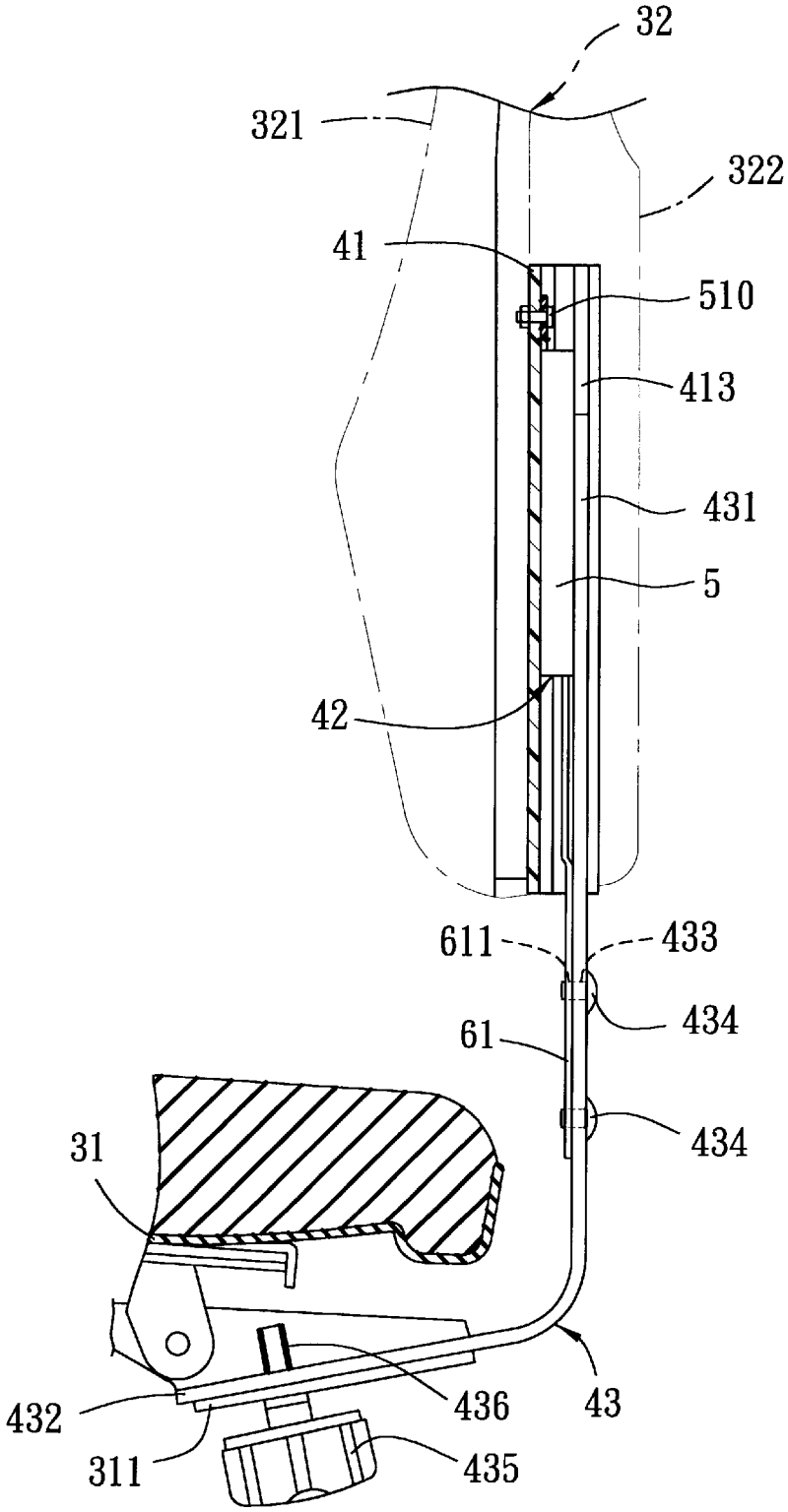
FIG. 6 is a fragmentary side sectional view of the preferred embodiment interconnecting the seat and backrest members, illustrating a lower plate portion extended from a bottom end of the backrest member.
Figure 7:
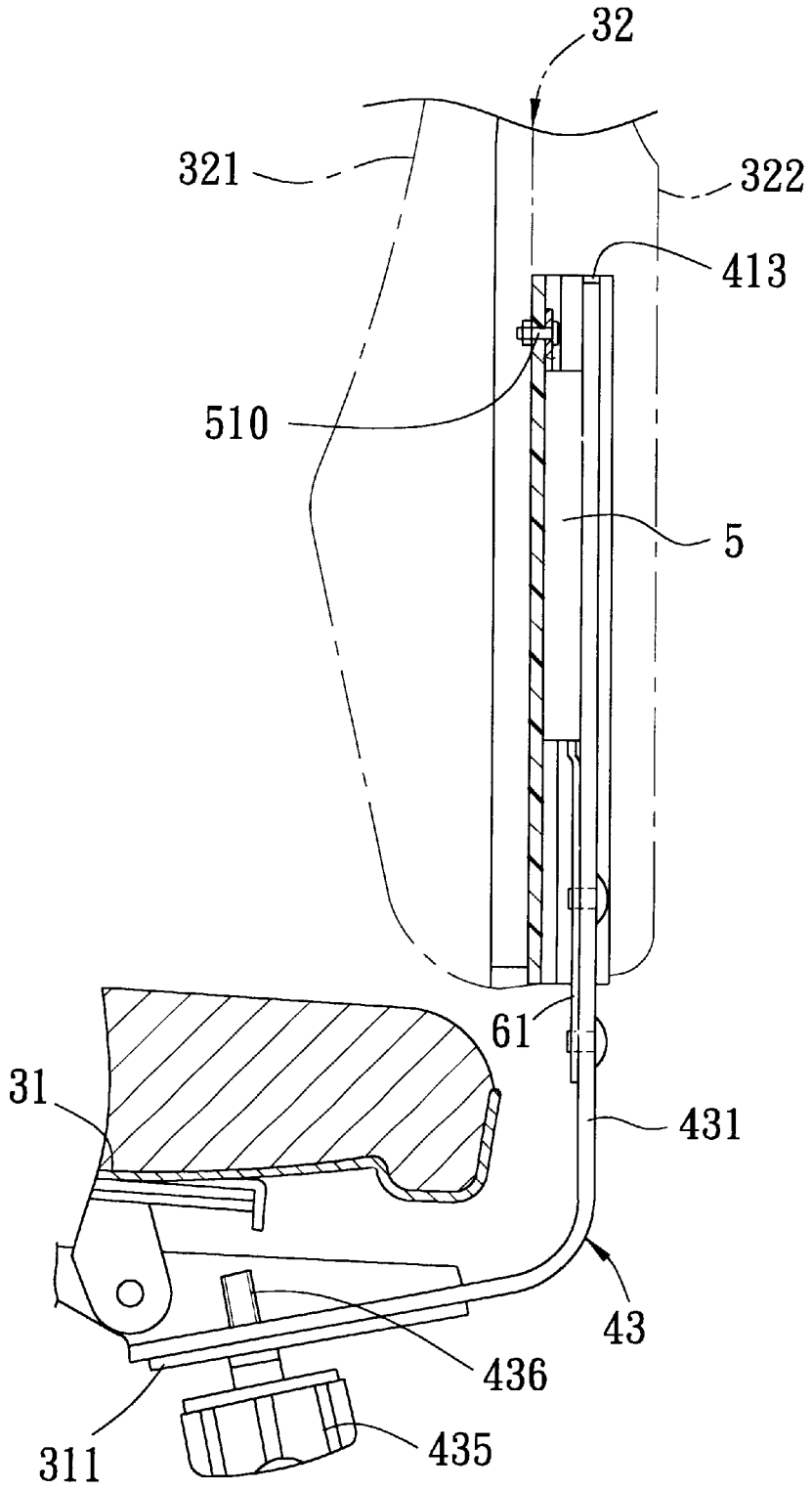
FIG. 7 is a view similar to FIG. 6, with the lower plate portion shown in a retracted state.

Referring to FIG. 5, during assembly of the backrest member 32, the retaining mechanism 42 is firstly secured to the elongated sliding member 41, which is mounted to the front or rear backrest portion 321, 322 with the insert space 413 thereof oriented towards the front or rear backrest portion 321, 322. The front and rear backrest portions 321, 322 are then coupled in a known manner to enclose the elongated sliding member 41 and the retaining mechanism 42 therewithin, with a lower end of the lower mounting plate portion 61 extending downwardly from a bottom end of the backrest member 32. During packaging, in order to save space, the lower mounting plate portion 61 can be slidably pushed upward such that it projects slightly from the bottom end of the backrest member 32, such as that shown in FIG. 5. To connect the backrest member 32 to the seat member 31, the lower mounting plate portion 61 is pulled downwardly to a position indicated by 61' in FIG. 5 to expose both of the positioning holes 611. Then, the distal end portion 431 of the mounting frame 43 is inserted upwardly into the insert space 413 confined by the elongated sliding member 41, with the positioning holes 433 thereof aligning with the positioning holes 611. Through the use of the screws 434, the mounting portion 6 and the mounting frame 43 are connected integrally, as shown in FIG. 6. Thereafter, the proximate end portion 432 is secured to a securing plate 311 disposed at the bottom side of the seat member 31 by means of the threaded rod 436 of the rotary knob 435. Hence, the backrest member 32 may be slidably moved upwardly or downwardly to permit adjustment of the relative distance between the backrest member 32 and the seat member 31, such as that shown in FIG. 7.

By means of the above construction, the height of the backrest member 32 relative to the seat member 31 is adjustable even after coupling of the front and rear backrest members 321, 322. Besides, the mounting frame 43 and the backrest member 32 together with the elongated sliding member 41 and the retaining mechanism 42 can be packed separately in a packaging box with the mounting frame 43 conveniently stuffed into any gap in the box so as to save packaging material.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A concealable height adjusting device adapted to be mounted between a seat member and a backrest member of a chair, the backrest member extending in an upright direction, said height adjusting device comprising:

a mounting frame including a proximate end portion adapted to be secured to the seat member, and a distal end portion extending from said proximate end portion in the upright direction and adapted to be disposed rearwardly of the backrest member;

an elongated sliding member adapted to be secured to the backrest member; and a slidable and unidirectionally retaining mechanism disposed between said distal end portion and said elongated sliding member to position said distal end portion relative to said elongated sliding member, said retaining mechanism including:

a linear-movement actuated engaging member including:

a mounting portion with first and second mounting walls opposite to each other in a first transverse direction relative to the upright direction;

a pawl portion having a pivot end pivotally mounted to said first mounting wall about a pivot axis parallel to the first transverse direction, and an engaging end provided with an engaging key which extends in the first transverse direction; and a first biasing member disposed to bias said engaging key to turn clockwise about the pivot axis, and to displace in a second transverse direction which is transverse to both the upright direction and the first transverse direction, a multilevel engaged member including:

first and second retaining walls opposite to each other in the first transverse direction and slidable relative to said first mounting wall of said mounting portion in the upright direction, said first retaining wall having first and second inner lateral edges spaced apart from each other in the second transverse direction to define a keyway extending in the upright direction between upper and lower limits to receive and permit said engaging key to move relative to said keyway between said upper and lower limits, said first inner lateral edge defining a plurality of notches spaced apart from one another in the upright direction, and between said upper and lower limits, said notches extending in the second transverse direction and being communicated with said keyway so as to form a plurality of ratchet teeth such that once said multilevel engaged member has been moved downward to a first position where said upper limit is brought to abut against said engaging key, an initial upward movement of said multilevel engaged member from the first position will permit said engaging key to be biased by said first biasing member to move into and be engaged within one of said notches, and a subsequent upward movement thereof will cause said engaging key to slide over a corresponding one of said ratchet teeth against the biasing action of said first biasing member and to move into and be engaged within a next one of said notches until a second position is reached where said engaging key abuts against said lower limit;

an arrest member disposed to be moved with said multilevel engaged member from the first or second position so as to release said engaging key or to grip said engaging key such that said engaging key is confined within said keyway when said multilevel engaged member is being moved downward from the second position to the first position; and a barrier member disposed to hinder said arrest member from being moved with the upward movement of said multilevel engaged member so as to set said arrest member ready for moving with the downward movement of said multilevel engaged member to grip said engaging key.

2. A concealable height adjusting device according to claim 1, wherein said linear-movement actuated engaging member is disposed on said distal end portion, and said multilevel engaged member is disposed on said elongated sliding member.

3. A concealable height adjusting device according to claim 2, wherein said mounting portion is an integral part of said distal end portion, and said first mounting wall defines a receiving hole extending to communicate said first mounting wall with said second mounting wall such that said pawl portion is received in said receiving hole with said pivot end and said engaging end not extending beyond said first and second mounting walls in the first transverse direction, and such that said engaging key extends to be beyond said first mounting wall.

4. A concealable height adjusting device according to claim 3, wherein:

said arrest member includes first and second gripping walls opposite to each other in the first transverse direction, and disposed to face said second retaining wall and said first mounting wall respectively, said first gripping wall including a gripping slot extending in said upright direction, and in the first transverse direction to communicate said first gripping wall with said second gripping wall so as to accommodate and permit said engaging key to be gripped, and right and left lateral walls opposite to each other in the second transverse direction and disposed to be urged by a second biasing action to move away from each other; and said multilevel engaged member includes right and left abutment walls which are disposed on said second retaining wall, which extend in the upright direction, and which are spaced apart from each other in the second transverse direction by such a distance as to frictionally contact said right and left lateral walls to thereby permit said arrest member to move with the downward movement of said multilevel engaged member.

5. A concealable height adjusting device according to claim 4, wherein said arrest member includes a pair of shoulder portions extending respectively from said right and left lateral walls upwardly and inwardly; said barrier member including a pair of block members which are disposed above said gripping slot and which are formed by bending an uppermost end of said distal end portion towards said second retaining wall so as to respectively abut against said shoulder portions when said engaging key is in the second position.

6. A concealable height adjusting device according to claim 1, wherein said distal end portion has right and left sidewalls opposite to each other in the second transverse direction, and said elongated sliding member has right and left edges opposite to each other in the second transverse direction, and right and left guiding grooves disposed respectively on said right and left edges and extending in the upright direction such that said right and left guiding grooves slidably ride on said right and left sidewalls, thereby stabilizing the upward and downward movements of said multilevel engaged member.

... US 6,264,276 B1